US007398663B2

(12) United States Patent
Jo

(10) Patent No.: US 7,398,663 B2
(45) Date of Patent: Jul. 15, 2008

(54) DRUM-TYPE WASHING MACHINE

(75) Inventor: Seong Jin Jo, Changwon-si (KR)

(73) Assignee: LG Electronics Inc., Seoul (KR)

( * ) Notice: Subject to any disclaimer, the term of this patent is extended or adjusted under 35 U.S.C. 154(b) by 567 days.

(21) Appl. No.: 10/686,524

(22) Filed: Oct. 16, 2003

(65) Prior Publication Data

US 2004/0123633 A1 Jul. 1, 2004

(30) Foreign Application Priority Data

Oct. 16, 2002 (KR) ..... 10-2002-0063312

(51) Int. Cl.
*D06F 37/22* (2006.01)

(52) U.S. Cl. ..... 68/23.2; 68/24

(58) Field of Classification Search ..... 68/3 R, 68/23 R, 23.2, 24, 58, 142
See application file for complete search history.

(56) References Cited

U.S. PATENT DOCUMENTS 4,136,079 A * 1/1979 Katayama et al. ..... 524/779
5,171,769 A * 12/1992 Bull et al. ..... 523/447
5,196,506 A * 3/1993 Tamai et al. ..... 528/353
5,419,164 A * 5/1995 Durazzani ..... 68/23.2
5,733,644 A * 3/1998 Tanaka et al. ..... 428/215
5,965,236 A * 10/1999 Durazzani ..... 428/156
2003/0008105 A1 * 1/2003 Haack et al. ..... 428/136

FOREIGN PATENT DOCUMENTS

EP 1538252 A1 * 6/2005

* cited by examiner

*Primary Examiner*—Joseph L. Perrin
(74) *Attorney, Agent, or Firm*—McKenna Long & Aldridge LLP

(57) ABSTRACT

A drum-type washing machine having a self-balancing outer tub assembly is provided by which balance of the outer tub assembly is maintained while the drum is rotated, without the use of a separately installed counterbalance for the front part of the tub assembly. The outer tub assembly includes a front outer tub having an open front and rear; and a rear outer tub having a closed end and an open end coupled to the front outer tub. The front outer tub is formed of a material having a specific gravity higher than that of the rear outer tub and/or has a thickness greater than that of the rear outer tub.

18 Claims, 7 Drawing Sheets

DRUM-TYPE WASHING MACHINE

This application claims the benefit of Korean Application No. 10-2002-0063312 filed on Oct. 16, 2002, which is hereby incorporated by reference.

BACKGROUND OF THE INVENTION

1. Field of the Invention

The present invention relates to a drum-type washing machine, and more particularly, to a drum-type washing machine having a self-balancing outer tub assembly.

2. Discussion of the Related Art

Referring to FIG. 1, the exterior construction of a drum-type washing machine according to a related art includes a cabinet frame 2, a cabinet front cover 4 providing the cabinet with a forward-facing opening 4*a* in which a door assembly 5 having a view port is installed, and a base assembly 8 on which the cabinet frame is supportably mounted. A top plate assembly 6 is mounted atop the cabinet frame 2, and a control panel assembly 7, provided with user interface features, is installed at one end of the top plate assembly 6. The door assembly 5 provides access to the interior of the drum-type washing machine.

Referring to FIG. 2, showing the interior construction of a drum-type washing machine according to a related art, a drum 10 for holding laundry is rotatably installed within a cylindrical outer tub for supporting the rotating drum and laundry. The outer tub is typically manufactured by injection molding of a synthetic resin-based material and may be integrally formed as one body or, to enable manufacture using smaller molds, may be constituted as front and rear outer tubs 12 and 14, as shown in the drawing. The front and rear outer tubs 12 and 14 are generally formed of the same material, e.g., a polypropylene containing about 25% glass fiber or a polypropylene containing about 10% glass fiber and about 17% $CaCO_3$, and are tightly coupled to each other to create a watertight junction.

Notably, the constitution of the rear outer tub 14 is fundamentally different from that of the front outer tub 12. For example, the rear outer tub 14 has one end closed, save a through-hole 14*a* for receiving a rotational shaft (not shown) on which the drum 10 is rotated, and is inherently heavier than the front outer tub 12, which has an open front and rear. Moreover, a plurality of reinforcing ribs 14*b* is formed at the rear of the rear outer tub 14, to withstand vibrations generated when the drum 10 is rotated. It should be appreciated that the fundamental differences between the front and rear outer tubs 12 and 14 would be present even in the case of an integrally formed outer tub assembly. In either case, the weight distribution of the cylindrical outer tub results in its forward part being much lighter. That is, in spite of being formed of the same material, the front and rear outer tubs 12 and 14 exhibit a substantial difference in weight, due to their contrasting structures and functions.

Referring to FIG. 3, the constructional differences between the front and rear outer tubs 12 and 14 become more apparent. For example, in a direct drive system in which the motor assembly (not shown) is mounted on the rear side of the rear outer tub 14 at the drum's central axis, a pair of bearings 14*c* are installed within the through-hole 14*a* to support the rotational shaft, and a spider (not shown) is provided to disperse the forces of a shear stress transferred to the rear outer tub 14 during drum rotation. The motor assembly consists of a stator assembly and a rotor assembly.

The weight difference between the front and rear outer tubs 12 and 14 brings about shaking and noise when the drum 10 is rotating. Therefore, a counterbalance 16 for maintaining the balance of the front and rear outer tubs 12 and 14 is installed at one end of the front outer tub 12, namely, the forward end, to counteract the forces and effect of the rotating drum 10. While the counterbalance 16 is typically mounted to the front exterior of the tub assembly, its precise positioning is determined by the characteristics of the washing machine, and in particular, by the weight distribution of the rear outer tub 14. In any event, the counterbalance 16 is positioned in direct opposition to the weight imbalance of the rear outer tub 14.

The counterbalance 16 may be realized by one of several means, including a ring-type counterbalance fixed in two parts to the front outer tub 12, as shown in the drawings, using a coupling means such as a plurality of screws. Such a counterbalance is achievable by molding a dense cement or by filling with cement the interior of a synthetic resin-based casing having an opening for inserting the cement.

In a drum-type washing machine according to the related art, however, the number of manufacturing components is increased, which substantially increases the part count and increases assembly time accordingly. Besides, the counterbalance itself is a very heavy, cumbersome component. Moreover, the cement of the counterbalance generates cement powder and other contaminants and therefore deteriorates the manufacturing environment and increases the likelihood of operational malfunction by introducing such contaminants to the interior of the manufactured product.

SUMMARY OF THE INVENTION

Accordingly, the present invention is directed to a drum-type washing machine that substantially obviates one or more of the problems due to limitations and disadvantages of the related art.

An object of the present invention, which has been devised to solve the foregoing problem, lies in providing a drum-type washing machine, by which balance of the outer tub assembly is maintained while the drum is rotated, without the use of a separately installed counterbalance for the front part of the tub assembly.

It is another object of the present invention to provide a drum-type washing machine, by which the part count is decreased.

It is another object of the present invention to provide a drum-type washing machine, by which assembly time is decreased.

It is another object of the present invention to provide a drum-type washing machine, by which productivity is increased.

It is another object of the present invention to provide a drum-type washing machine, by which the manufacturing environment is improved.

It is another object of the present invention to provide a drum-type washing machine, by which reliability of the manufactured product is improved.

It is another object of the present invention to provide a drum-type washing machine, by which installation and use of a cement-based counterbalance is obviated.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a drum-type washing machine having a self-balancing outer tub assembly comprising a front outer tub having an open front and rear; and a rear outer tub having a closed end and an open end coupled to the front outer tub. The front outer tub is formed of a material having a specific gravity higher than that of the rear outer tub and/or has a thickness greater than that of the rear outer tub. The material of the front outer tub is preferably a polymer combined with a metal powder such as iron or aluminum or a polymer combined with an inorganic substance such as talc, CaCO3, or silicon. The front outer tub may incorporate an insert member of a high specific gravity, and one or more middle outer tubs may be additionally coupled between the front and rear outer tubs or may be integrally formed as one body.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENTS

Reference will now be made in detail to the preferred embodiments of the present invention, examples of which are illustrated in the accompanying drawings. Throughout the drawings, like elements are indicated using the same or similar reference designations where possible.

Figure 1:
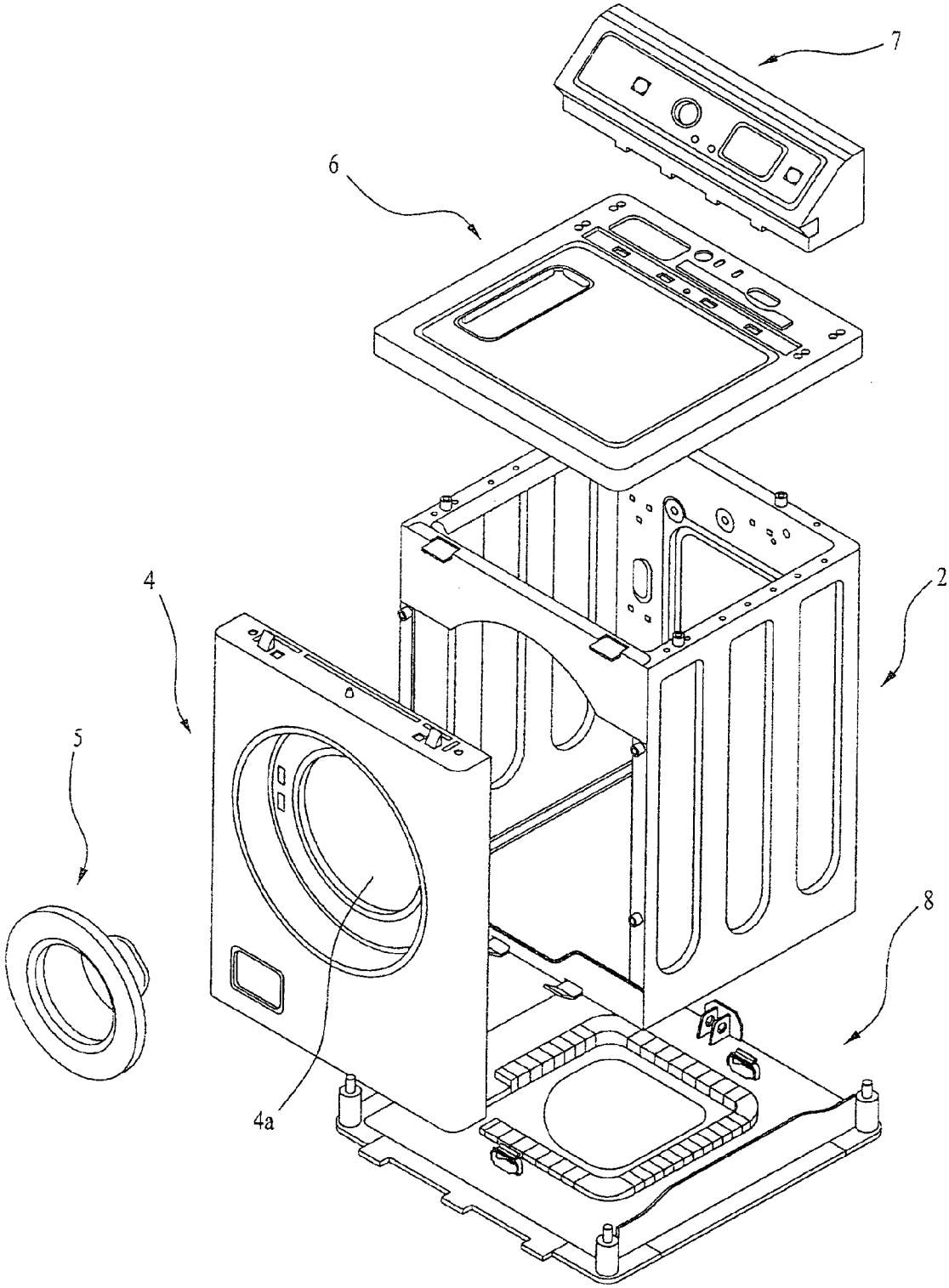
FIG. 1 Prior Art
FIG. 1 is a perspective breakaway view of a drum-type washing machine according to a related art, illustrating the exterior construction thereof.
Figure 2:
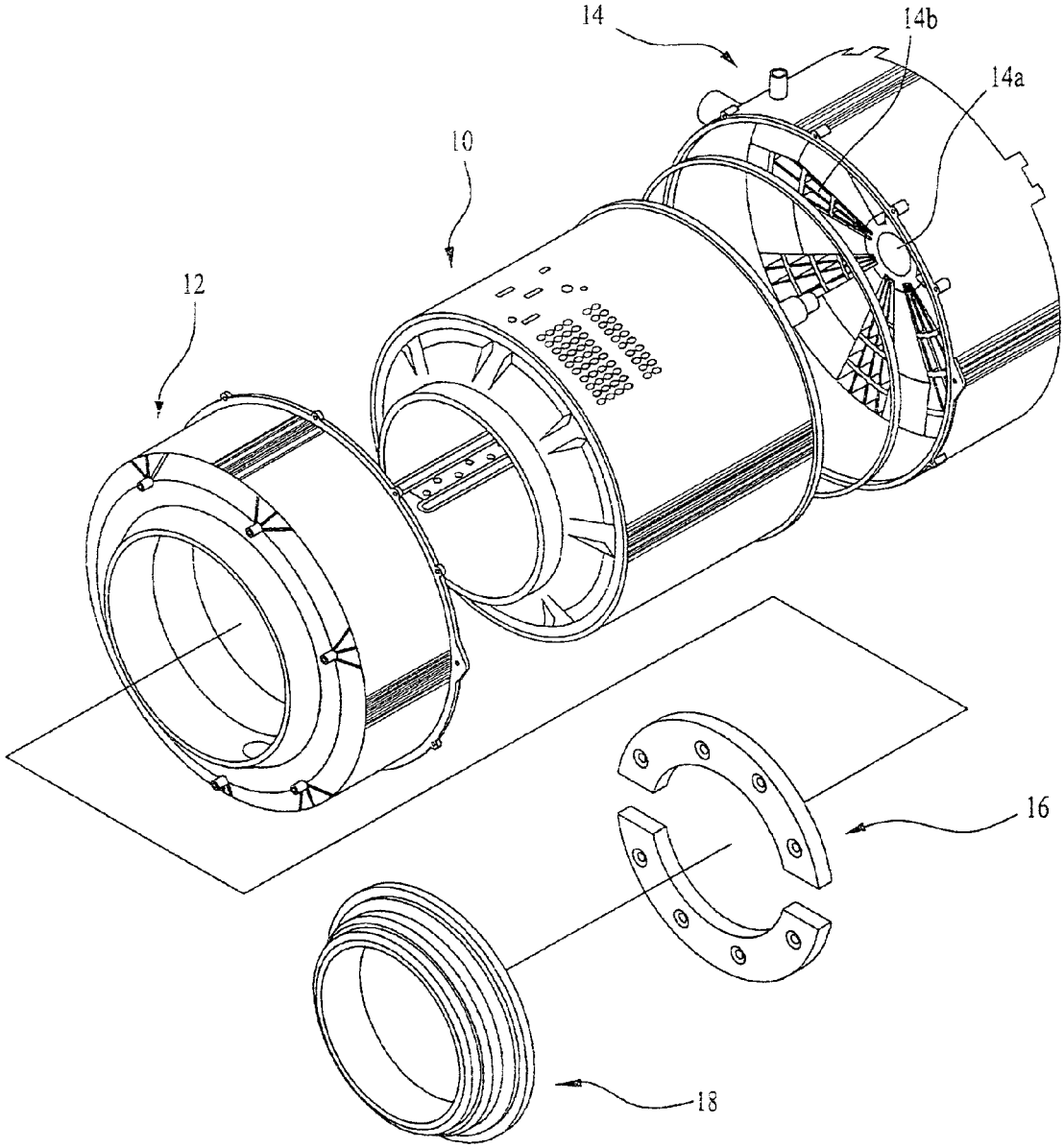
FIG. 2 Prior Art
FIG. 2 is a perspective breakaway view of a drum-type washing machine according to a related art, illustrating the interior construction thereof.
Figure 3:
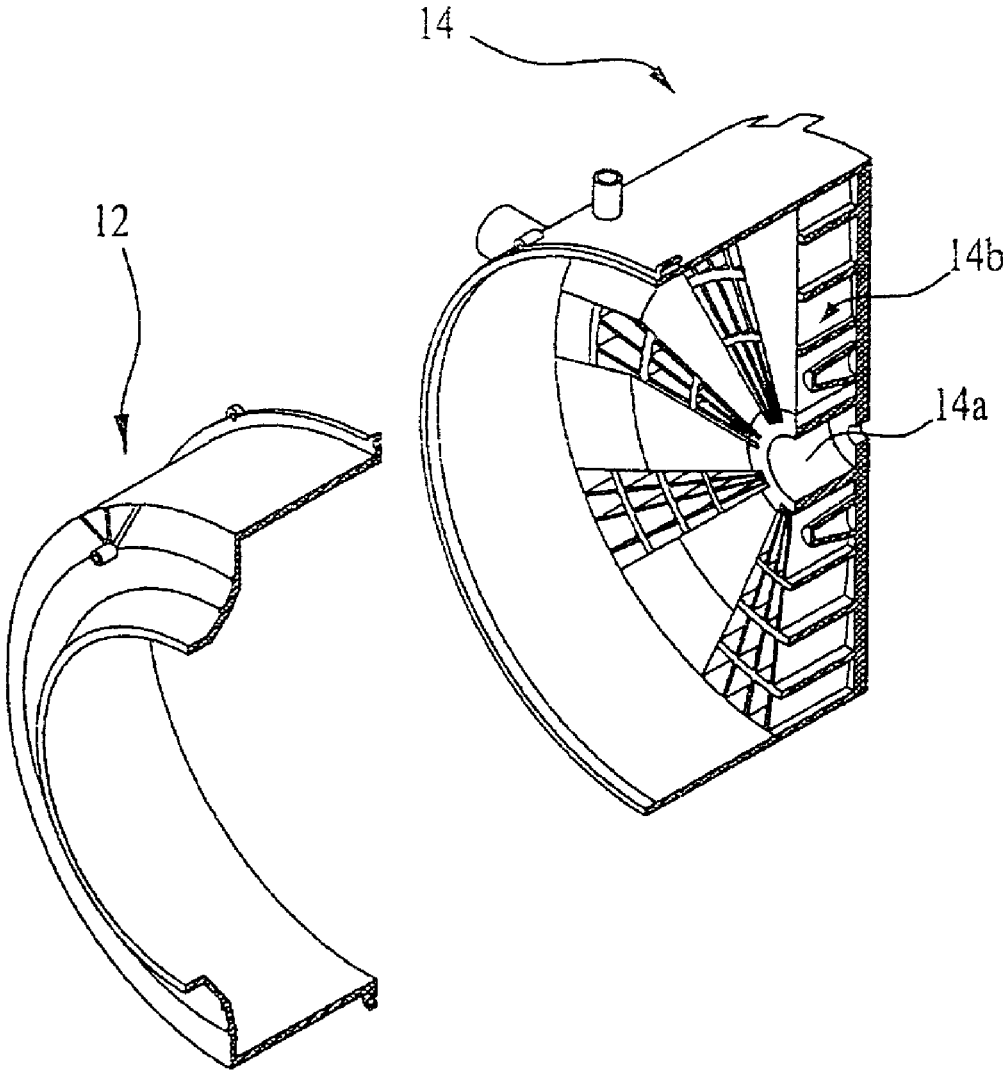
FIG. 3 Prior Art
FIG. 3 is a cutaway view of the outer tub assembly of FIG. 2.
Figure 4A:
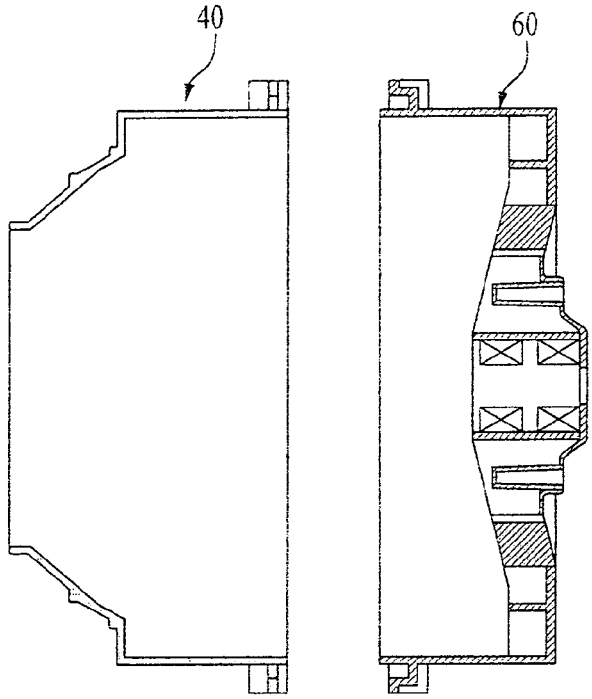
FIGS. 4A and 4B are cross-sectional views of an outer tub assembly according to a first embodiment of the present invention.
Figure 4B:
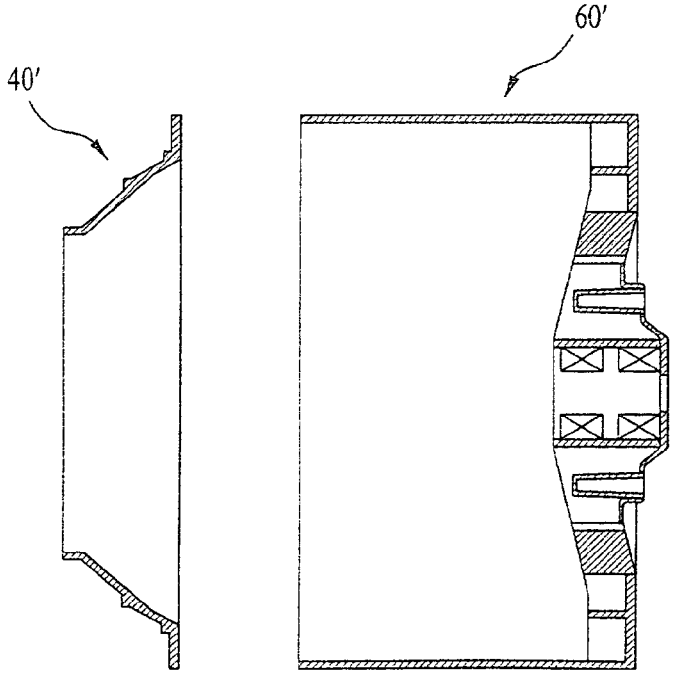

FIGS. 4A and 4B illustrate an outer tub assembly according to a first embodiment of the present invention, in which a front outer tub 40 and a rear outer tub 60 are employed. The front and rear outer tubs 40 and 60 share many of the same features as those of the related art tub assembly, including the relative weight differential. For example, the front and rear outer tubs 40 and 60 each have a cylindrical shape, but the rear outer tub 60 has a closed end and a plurality of reinforcing ribs and a pair of bearings are installed at the closed end of the rear outer tub. The front and rear outer tubs 40 and 60 are tightly coupled to each other to create a watertight junction, using a coupling means such a plurality of screws, to complete the outer tub assembly.

In contrast, however, the front outer tub 40 is formed so as to be heavier than the rear outer tub 60, such that balance is kept with respect to the weight of the rear outer tub, thus obviating the counterbalance of the related art. That is, in the present invention, the front outer tub 40 is formed of a material of a high specific gravity, to be heavier than that of the rear outer tub 60 and thereby maintain balance with respect thereto. While the material of the rear outer tub 60 is a synthetic resin-based material as in the related art, the material of the front outer tub 40 according to the present invention is a contrasting substance.

According to the first embodiment of the present invention, the front outer tub 40 is formed of a polymer, such as polypropylene, polyethylene, polyvinyl chloride, or the like, combined with a heavy metal or inorganic substance. Preferably, a metal material having a high specific gravity (e.g., iron, $Fe_2O_3$, $Fe_2O_4$, or aluminum) is used, but the particle size of the metal must be small enough to allow injection molding of the synthetic resin-based material. As for the inorganic substance, talc, $CaCO_3$, or silicon is acceptable for injection molding. In adding the metal particles or inorganic substance to the polymer, a bonding additive is appropriately mixed with either, and the resultant is injection-molded to complete the front outer tub 40, to produce a front outer tub having a specific gravity substantially higher than one using only the polymer.

By employing contrasting materials as above, proper balance between the front and rear portions of the outer tub assembly is achieved by determining the axial lengths of the front and rear outer tubs 40 and 60, respectively. For instance, the length of the front outer tub 40 containing high-specific-gravity particles is determined based on an overall weight of the outer tub assembly and will vary depending on the type of particles employed. At the same time, the front outer tub 40 may be longer than the rear outer tub 60, as necessary. Thus, as shown in FIG. 4B, the particles employed and the specific gravity achieved may allow for a much shorter front portion of the outer tub assembly. Here, the outer tub assembly is comprised of an outer tub cover 40' and an outer tub main body 60'.

Figure 5:
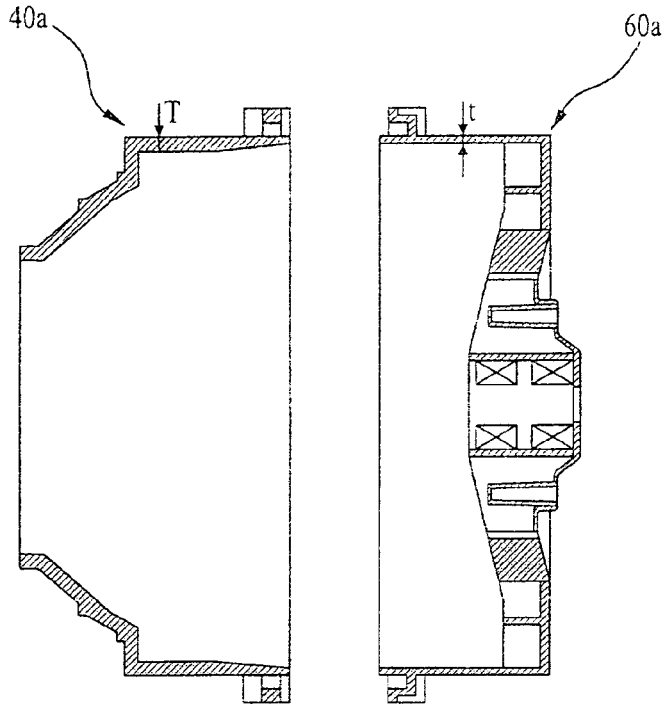
FIG. 5 is a cross-sectional view of an outer tub assembly according to a second embodiment of the present invention.

Referring to FIG. 5, an outer tub assembly according to a second embodiment of the present invention includes a front outer tub 40*a* and a rear outer tub 60*a*, with the rear outer tub being equivalent to that of the related art. Likewise in this embodiment, the front outer tub 40*a* is formed so as to be heavier than the rear outer tub 60*a*, such that balance is kept with respect to the weight of the rear outer tub.

In the second embodiment, however, a thickness T of the walls of the front outer tub 40*a* is greater than a thickness t of the walls of the rear outer tub. 60*a*. This difference in thicknesses T and t is such that the front outer tub 40*a* exhibits a sufficient weight to counterbalance that of the rear outer tub 60*a*. Here, proper axial lengths of the front outer tub 40*a* and rear outer tub 60*a* are determined based on the thicknesses selected, whereby a greater thickness differential enables a shorter front outer tub or a longer rear outer tub and vice versa. The thickness differential may be employed in conjunction with the contrasting specific gravities of the first embodiment.

In the event that an indirect drive system is employed, whereby the motor assembly is mounted asymmetrically with respect the drum's central axis, the front outer tub 40*a* may likewise be asymmetrically formed, such that the thickness T is unevenly distributed to compensate for the imbalance.

Figure 6:
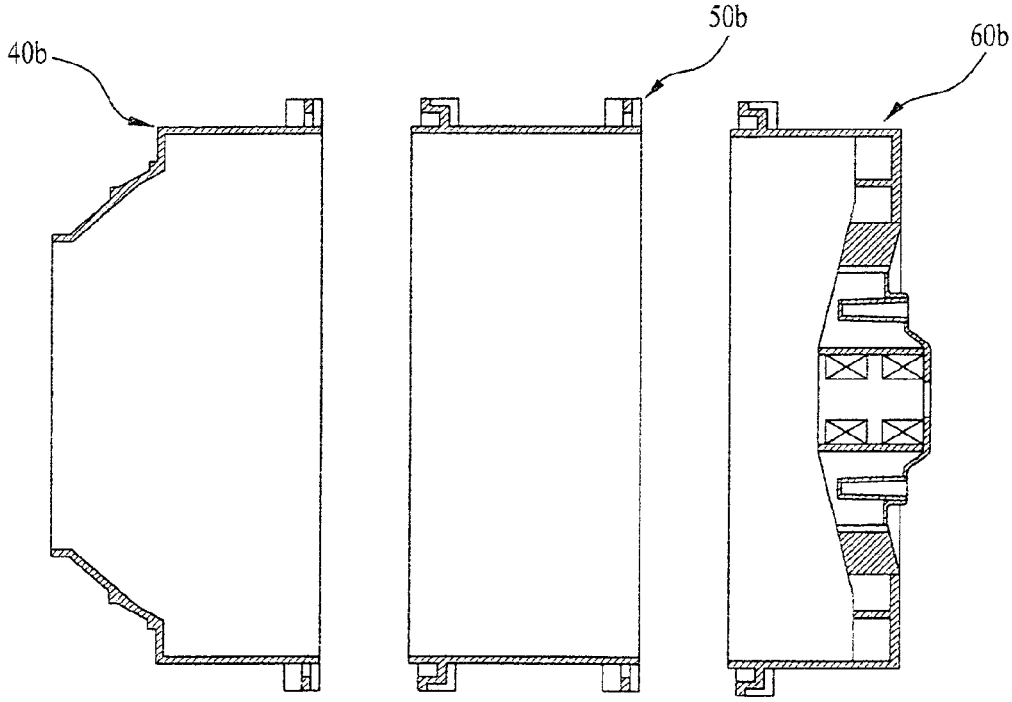
FIG. 6 is a cross-sectional view of an outer tub assembly according to a third embodiment of the present invention.

Referring to FIG. 6, an outer tub assembly according to a third embodiment includes a front outer tub 40*b*, a middle outer tub. 50*b*, and a rear outer tub 60*b*, such that the outer tub assembly consists of three cylindrical sections, enabling even smaller molds than with a two-section outer tub assembly. The front and middle outer tubs 40*b* and 50*b* each have an open front and rear, and the rear outer tub 60 has a closed-end construction including the same heavy components as in the related art. The front, middle, and rear outer tubs 40*b*, 50*b*, and 60*b* are tightly coupled to each other to create a watertight junction, using a coupling means such a plurality of screws, to complete the outer tub assembly.

In the third embodiment of the present invention, the combination of thickness differential and contrasting specific gravities of the second embodiment is applied to the front and/or middle outer tubs 40*b* and 50*b*. In doing so, the axial lengths of each of the front, middle, and rear outer tubs 40*b*, 50*b*, and 60*b* are determined in a corresponding manner. The outer tub assembly according to the third embodiment may be comprised of more than three sections, with the same principle being applied to all except the closed-end section.

Figure 7:
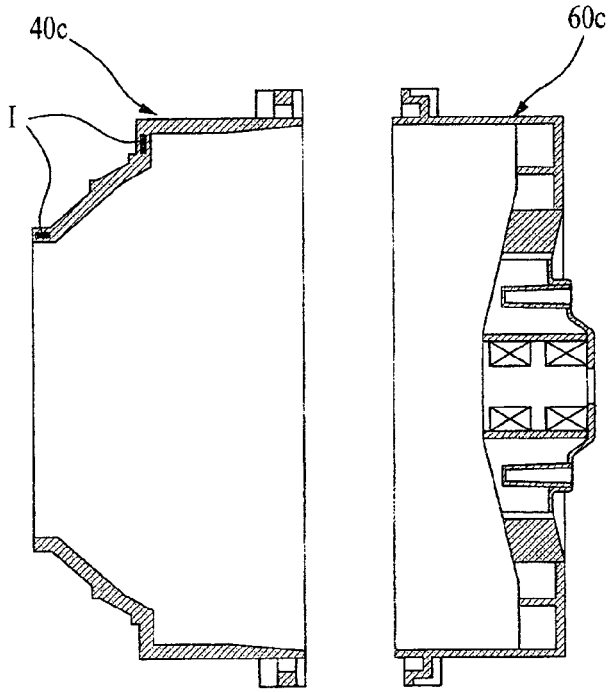
FIG. 7 is a cross-sectional view of an outer tub assembly according to a fourth embodiment of the present invention.

Referring to FIG. 7, an outer tub assembly according to a fourth embodiment includes a front outer tub 40*c* and a rear outer tub 60*c*. To increase the weight of the front outer tub, however, the front outer tub 40*c* is formed through a process of insert injection molding, which is sometimes referred to as insert molding, to insert a member I at the front end of the front outer tub. The member I, which is preferably annular in configuration, is made of a metal-based material of a high specific gravity, such as iron, and a plurality of such members may be employed. In the fourth embodiment, the combination of thickness differential and contrasting specific gravities of the second embodiment may be applied, the axial lengths of each section of the outer tub assembly are determined in a corresponding manner, and more than two sections may be employed.

While outer tub assemblies of the foregoing embodiments each comprise a plurality of separately formed sections, which are assembled together, the outer tub assemblies of the following embodiments are each constructed as an integrally formed body.

Figure 8:
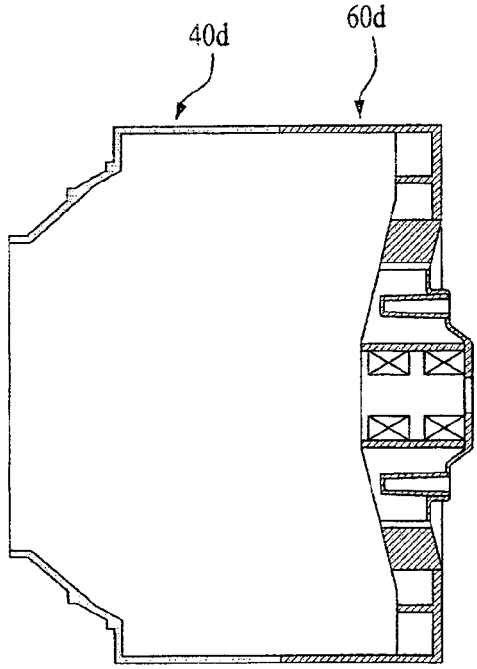
FIG. 8 is a cross-sectional view of an outer tub assembly according to a fifth embodiment of the present invention.

Referring to FIG. 8, an outer tub assembly according to the fifth embodiment includes a front portion 40*d* and a rear portion 60*d*, which are integrally formed as one body. The front portion 40*d* is formed of a material having a high specific gravity, and as in the case of the first embodiment, may be realized by injection molding using a synthetic resin-based material containing metal particles or an inorganic substance of a high specific gravity. The front portion 40*d* undergoes insert injection molding or dual injection molding together with the rear portion 60*d*. This embodiment may be considered as corresponding to the first embodiment.

Figure 9:
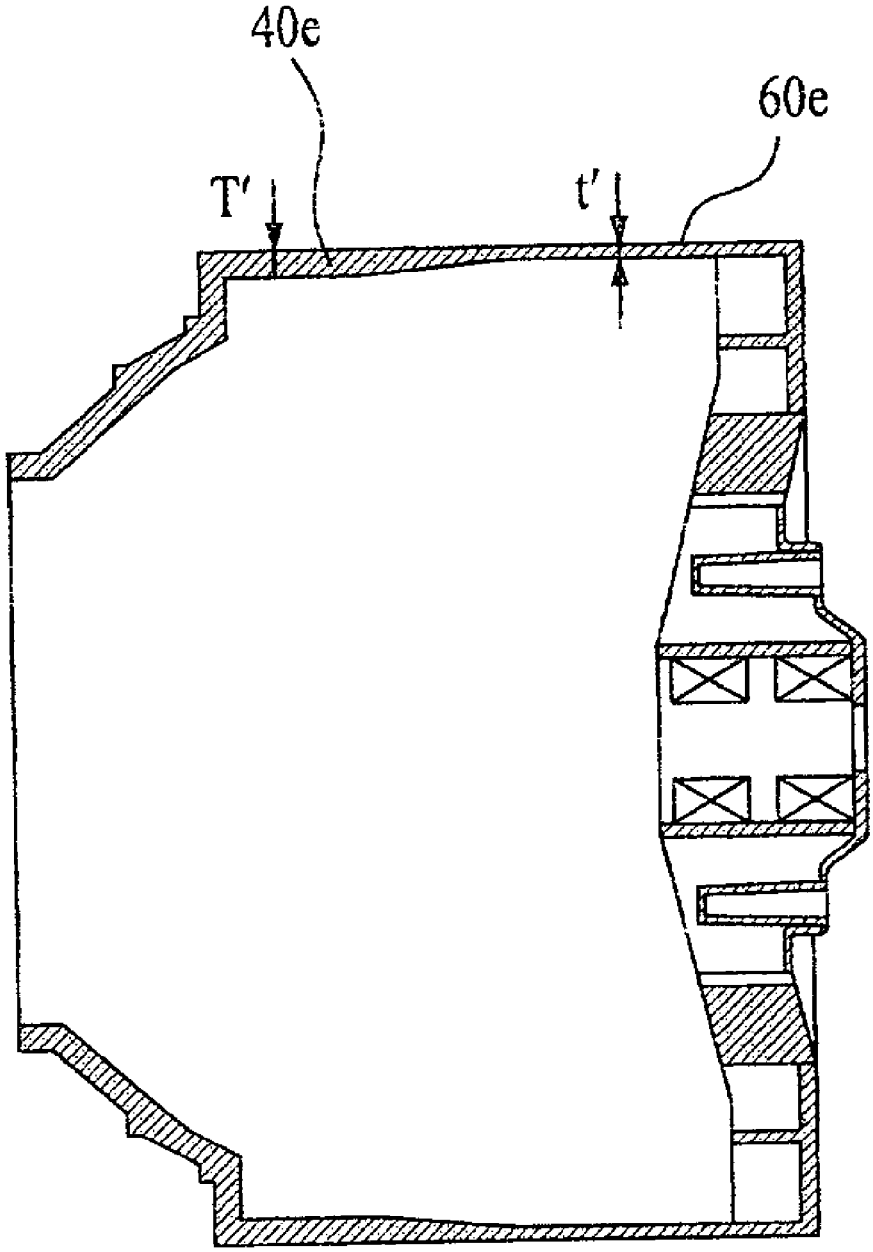
FIG. 9 is a cross-sectional view of an outer tub assembly according to a sixth embodiment of the present invention.

Referring to FIG. 9, an outer tub assembly according to a sixth embodiment includes a front portion 40*e* and a rear portion 60*e*. Here, a thickness T' of the front portion 40*e* is greater than a thickness t' of the rear portion 60*e*. This embodiment may be considered as corresponding to the first embodiment.

Adopting the outer tub assembly according to the present invention enables the manufacture of a drum-type washing machine in which balance of the outer tub assembly is maintained while the drum is rotated, without the use of a separately installed counterbalance for the front part of the tub assembly. Thus, the number of manufacturing components is decreased, which substantially reduces the part count and in turn reduces assembly time. Since the cement powder and other contaminants of the counterbalance of the related art are avoided, the manufacturing environment and product reliability are improved.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A drum-type washing machine having a self-balancing outer tub assembly without having a separately installed counterbalance, the outer tub assembly comprising:

a front outer tub having formed of a first injection molded compound having a first specific gravity, wherein the front outer tub comprises an open front and an open rear; and a rear outer tub formed of a second injection molded compound having a second specific gravity, different from the first, wherein the rear outer tub comprises a closed end and an open end coupled to said open rear of said front outer tub, wherein said first specific gravity is higher than said second specific gravity.

2. The drum-type washing machine as claimed in claim 1, wherein the first injection molded compound comprises a polymer and a metal powder.

3. The drum-type washing machine as claimed in claim 2, wherein the metal powder is iron-based.

4. The drum-type washing machine as claimed in claim 2, wherein the metal powder is aluminum-based.

5. The drum-type washing machine as claimed in claim 2, further comprising at least one insert member integrally formed with said front outer tub by an insert injection molding process, wherein said at least one insert member has a specific gravity higher than that of the polymer.

6. The drum-type washing machine as claimed in claim 1, wherein the first injection molded compound comprises a polymer and an inorganic substance.

7. The drum-type washing machine as claimed in claim 6, wherein the inorganic substance is one selected from the group consisting of talc, CaCO3, and silicon.

8. The drum-type washing machine as claimed in claim 1, further comprising at least one middle outer tub having an open front and rear, said at least one middle outer tub being coupled between said front and rear outer tubs.

9. The drum-type washing machine as claimed in claim 1, wherein said front and rear outer tubs are integrally formed as one body.

10. A drum-type washing machine having a self-balancing outer tub assembly without having a separately installed counterbalance, the outer tub assembly comprising:

a front outer tub having a first thickness and formed of a first injection molded compound having a first specific gravity, wherein the front outer tub comprises an open front and an open rear; and a rear outer tub having a second thickness and formed of a second injection molded compound having a second specific gravity, different from the first, wherein the rear outer tub comprises a closed end and an open end coupled to said front outer tub, wherein said first thickness is greater than said second thickness.

11. The drum-type washing machine as claimed in claim 10, wherein the first injection molded compound comprises a polymer and a metal powder.

12. The drum-type washing machine as claimed in claim 11, wherein the metal powder is iron-based.

13. The drum-type washing machine as claimed in claim 11, wherein the metal powder is aluminum-based.

14. The drum-type washing machine as claimed in claim 11, further comprising at least one insert member integrally formed with said front outer tub by an insert injection molding process, wherein said at least one insert member has a specific gravity higher than that of the polymer.

15. The drum-type washing machine as claimed in claim 10, wherein the first injection molded compound comprises a polymer and an inorganic substance.

16. The drum-type washing machine as claimed in claim 15, wherein the inorganic substance is one selected from the group consisting of talc, $CaCO_3$, and silicon.

17. The drum-type washing machine as claimed in claim 10, further comprising at least one middle outer tub having an open front and rear, said at least one middle outer tub being coupled between said front and rear outer tubs.

18. The drum-type washing machine as claimed in claim 10, wherein said front and rear outer tubs are integrally formed as one body.

* * * * *